US006361267B1

(12) United States Patent
Chuang

(10) Patent No.: US 6,361,267 B1
(45) Date of Patent: Mar. 26, 2002

(54) WHEELCHAIR SHIFTING AID

(76) Inventor: Ching-Shan Chuang, No. 16, Pin-An Cheng, Hou-Bei Chiang, Tainan (TW)

( * ) Notice: Subject to any disclaimer, the term of this patent is extended or adjusted under 35 U.S.C. 154(b) by 0 days.

(21) Appl. No.: 09/649,717

(22) Filed: Aug. 28, 2000

(51) Int. Cl.[7] ..... A61G 5/00

(52) U.S. Cl. ..... 414/539; 5/81 HS; 297/DIG. 4; 280/304.1; 414/921

(58) Field of Search ..... 5/81 HS; 297/DIG. 4; 280/304.1, 650, 657; 414/539, 921

(56) References Cited

U.S. PATENT DOCUMENTS 4,155,588 A * 5/1979 Danziger et al. ..... 297/115
5,058,221 A * 10/1991 Abraham ..... 5/81 HS
5,651,149 A * 7/1997 Garman ..... 5/81.1 R
5,884,929 A * 3/1999 Kincaid ..... 280/304.1

* cited by examiner

*Primary Examiner*—Steven A. Bratlie
(74) *Attorney, Agent, or Firm*—Pro-Techtor International Services

(57) ABSTRACT

A wheelchair shifting aid, mounted on a base of a wheelchair, comprising a seat, a central gliding track, two connecting plates, and several lateral guiding tracks. The seat is mounted on an upper side of the base. The central gliding track is located between the base and the seat, guiding the seat towards a front side of the wheelchair, then towards left and right sides of the wheelchair. The two connecting plates are hingedly connected with the base on two sides thereof, being able to be placed in horizontal positions, forming a single plane with the base. The several lateral guiding tracks are placed on the two connecting plates, guiding the seat to glide on the connecting plates. Thus the seat is guided towards a lateral side of the wheelchair.

3 Claims, 5 Drawing Sheets

WHEELCHAIR SHIFTING AID

BACKGROUND OF THE INVENTION

1. Field of the Invention

The present invention relates to a wheelchair shifting aid, particularly to a wheelchair shifting aid for assisting a person who has not the ability to move.

2. Description of Related Art

When nursing a completely disabled or paralyzed person or a person in a vegetative state, for shifting locations for treatment, exercise or washing, a wheelchair needs to be employed, allowing a nurse to move the person.

However, a regular wheelchair mostly has wheels on two sides of a seat, with armrests and a backrest on the seat. The armrests and the backrest are fastened on the seat.

Therefore, the only way to mount and dismount is from above the seat. A slightly disabled person is able to enter or to leave the wheelchair by using her or his own hands supported by the armrests. A patient who is completely disabled or paralyzed, however, needs to be carried for entering or leaving the wheelchair. Since the armrests form a barrier, a nurse has to embrace the patient and place her or him on the front part of the wheelchair before the patient can be seated on the wheelchair. This is very hard work, requiring a physically strong nurse.

Furthermore, there is no bridge between a regular wheelchair and a bed. Thus for shifting the patient between the wheelchair and a bed, the nurse has to move the wheelchair to the bed as close as possible, embrace the patient and carry her or him over. This is not only hard labor, but also risky, since the wheelchair may overturn or the nurse may drop the patient.

SUMMARY OF THE INVENTION

It is an object of the present invention to provide a wheelchair shifting aid, helping a nurse to shift a patient and reducing work for the nurse.

Another object of the present invention is to provide a wheelchair shifting aid which eliminates the risk of dropping the patient while shifting the patient.

The present invention can be more fully understood by reference to the following description and accompanying drawings.

DETAILED DESCRIPTION OF THE PREFERRED EMBODIMENT

Figure 1:
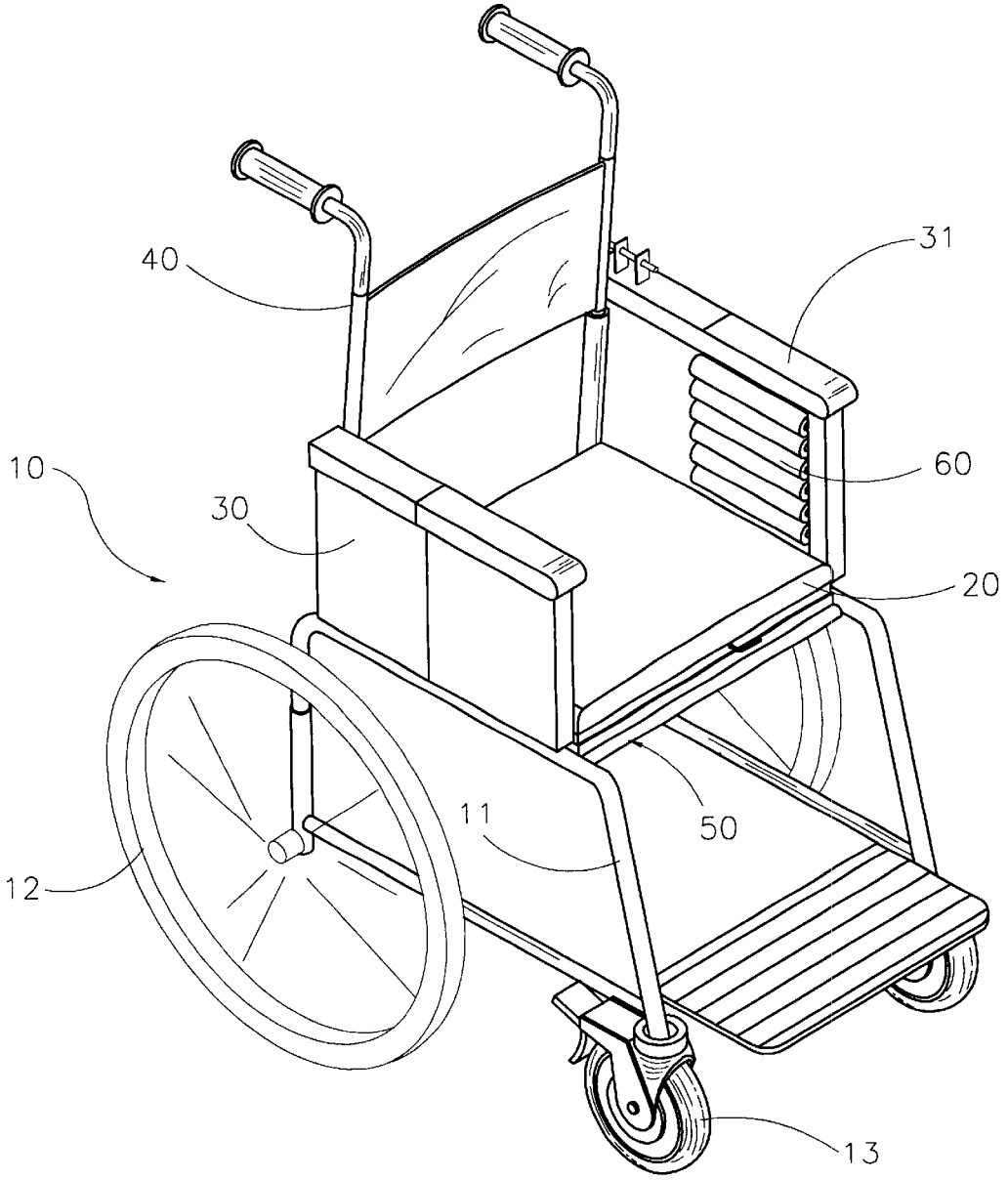
FIG. 1 is a perspective view of the present invention.

As shown in FIG. 1, the wheelchair shifting aid of the present invention mainly comprises: a wheelchair 10, having a base 11, two wheels 12 on two lateral sides of the base 11 and a pair of steering wheels 13 at a front side of the base 11 for steering the wheelchair 10; a seat 20, mounted on the base 11 on an upper side thereof and having two armrests 30 on the two lateral sides as well as a backrest 40 on a rear side.

Figure 2A:
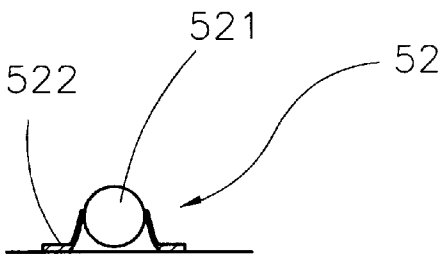
FIG. 2A is a sectional view of one of the ball rollers of the present invention.
Figure 2:
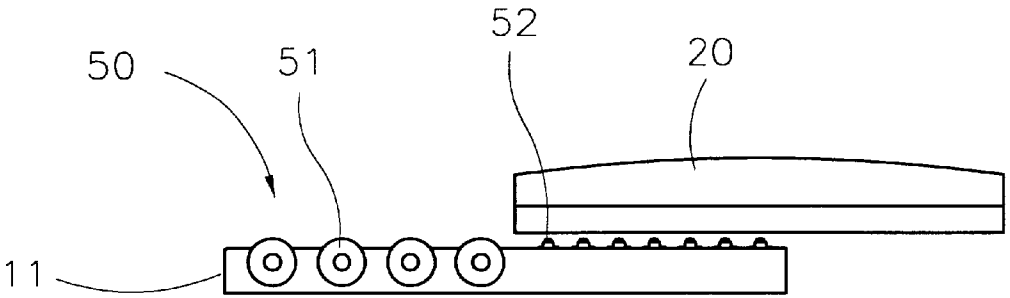
FIG. 2 is a side view of the wheelchair shifting aid of the present invention.
Figure 3:
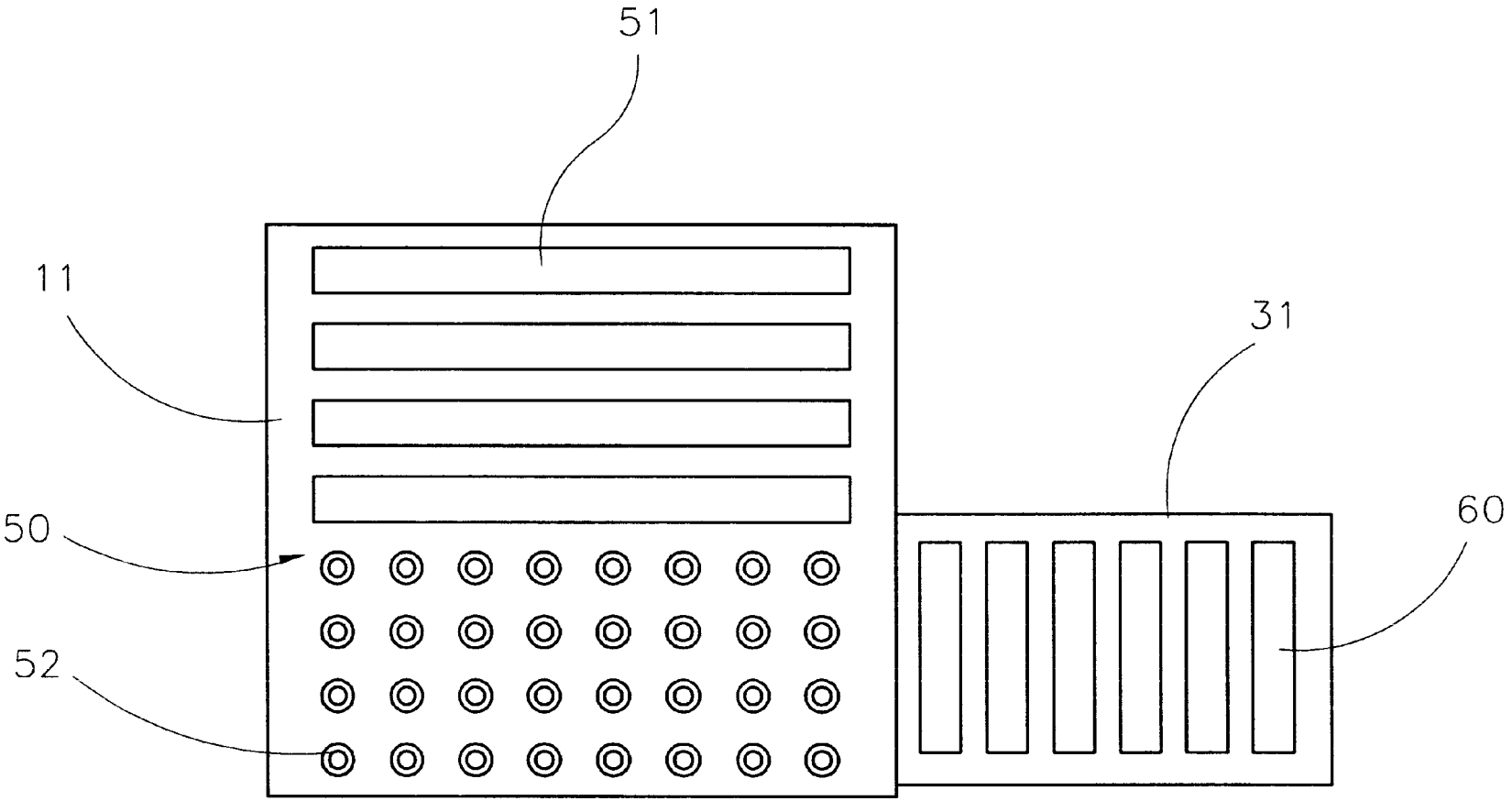
FIG. 3 is a top view of the central gliding track and the lateral gliding track of one of the connecting plates of the present invention.
Figure 4:
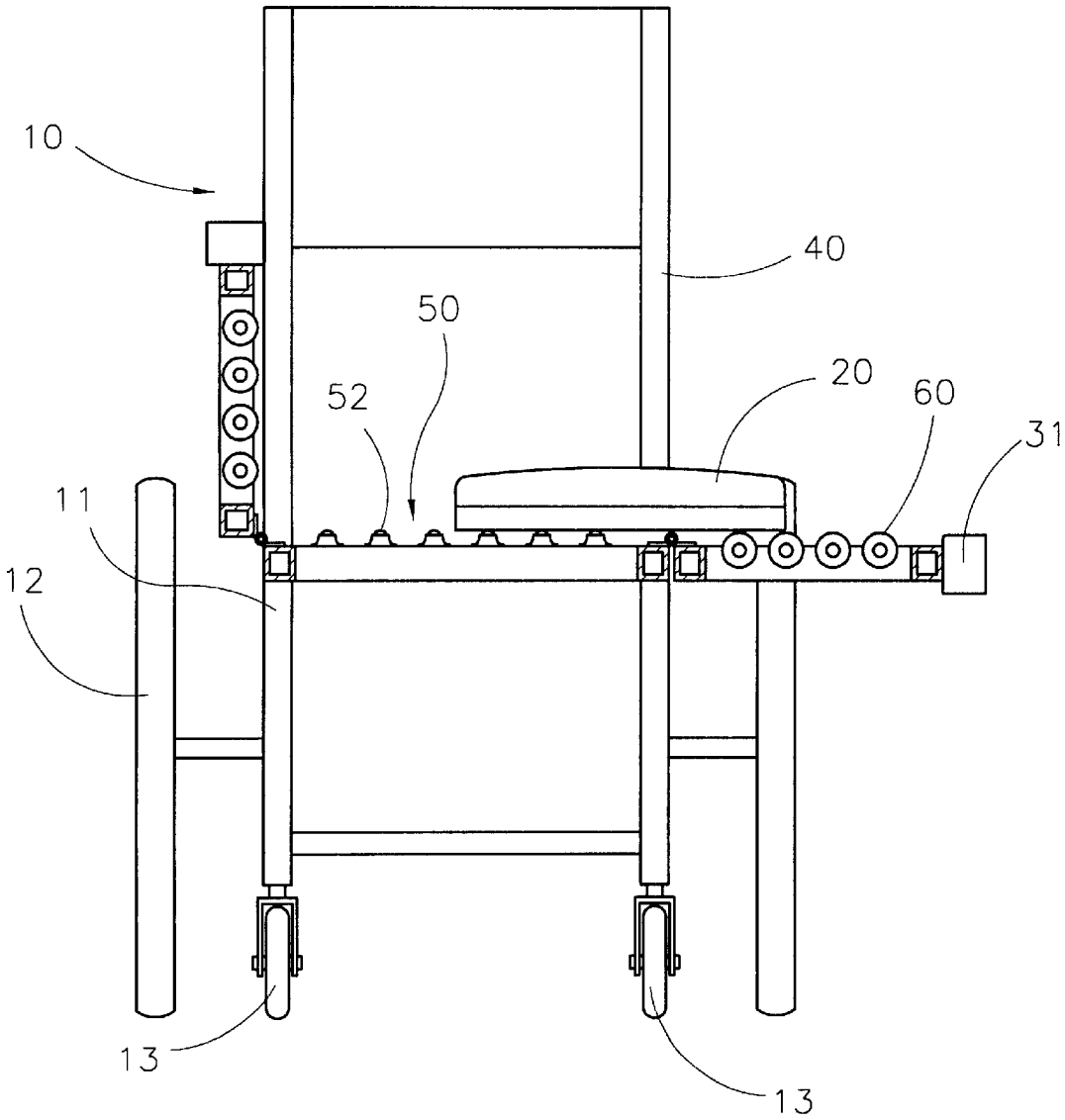
FIG. 4 is a front view of the present invention, with the connecting plate in the horizontal position.

Referring to FIGS. 2 and 3, the main characteristic of the present invention is a central gliding track 50, located between the base 11 and the seat 20, allowing the seat 20, after gliding forward, to glide to the left or to the right. Furthermore, two connecting plates 31 are disposed at front parts of the armrests 30. As shown in FIG. 4, the two connecting plates 31 are hingedly connected with the seat 20, allowing to lower the connecting plates 31 to horizontal positions.

As shown in FIG. 4, the two connecting plates 31, having been lowered to horizontal positions, have far ends which may be laid on a bed or another place, forming a horizontal bridge between the wheelchair and the bed. As shown in FIGS. 3 and 4, each of the two connecting plates 31 has a set of lateral gliding tracks 60 for guiding the seat 20 to glide on the connecting plate 31.

Since the wheels 12 of the wheelchair 10 reach higher than the base 11, the seat 20, before moving to the left or right, needs to be shifted forward to let the rear edge of the seat 20 stay in front of the wheels 12, so as not to be blocked by the wheels 12.

Referring to FIG. 2, the central gliding track 50 comprises two parts. A rear part close to the backrest 40 has several cylindrical rolls 51, and a front part has several ball rollers 52. As shown in FIG. 2A, each of the ball rollers 52 comprises a ball 521 and a positioning rim 522 for containing the ball 521. The positioning rim 522 is an upward extending circular rim with an upper edge that has a smaller diameter than the ball 521 and a height that exceeds the radius of the ball 521. Thus the ball 521 fits in the positioning rim 522, rotating freely therein.

Since the balls 521 are positioned by the positioning rims 522 on the upper side of the base 11, the balls 521 rotate in fixed positions. Therefore the seat 20, when in contact with the balls-521, is able not only to glide forward, but also to the lateral sides.

Referring again to FIG. 2, the seat is laid on the central gliding track 50. When the seat 20 starts to move forward, the lower side thereof is in contact both with the cylindrical rolls 51 and the ball rollers 52. Since the seat is guided by the cylindrical rolls 51, only a movement along a single direction is possible. After the seat 20 has traveled a certain distance forward, the rear edge of the seat 20 is separated from the cylindrical rolls 51, and it is possible for the seat 20 to move to the left or right of the wheelchair.

Figure 5:
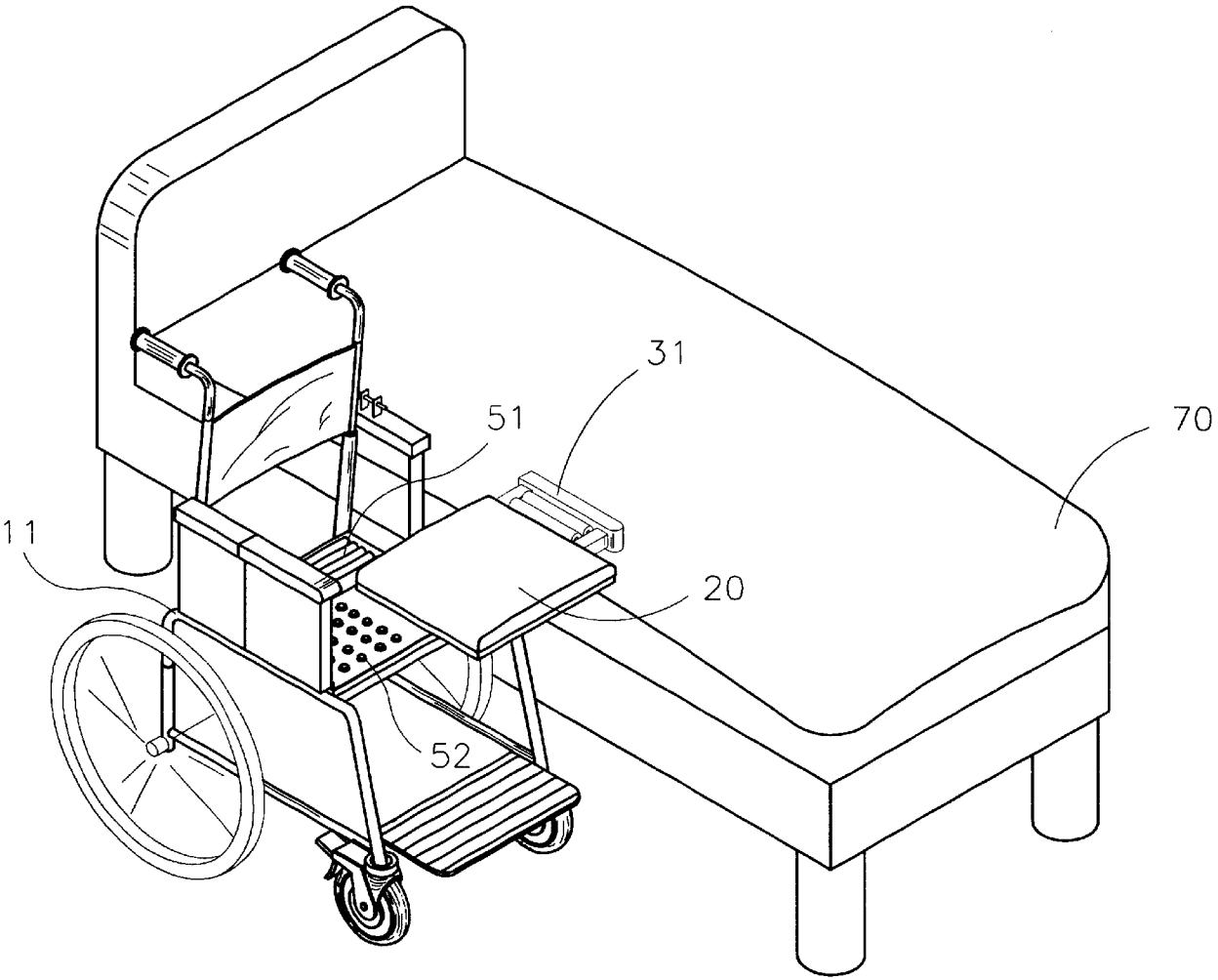
FIG. 5 is a perspective view of the present invention in use for shifting a patient.

Referring to FIGS. 4 and 5, when the seat 20 has moved above the connecting plate 31, the lateral gliding tracks 60 allow the seat 20 to continue to glide on the connecting plate 31.

As shown in FIG. 5, for moving a patient from a bed 70 to the wheelchair 10, the wheelchair 10 at a lateral side thereof is brought close to the bed 70, the connecting plate 31 is lowered to the horizontal position thereof, so that the far end thereof rests on an edge of the bed 70, the seat 20 is moved to the far end of the connecting plate 31, the patient is placed on the seat 20, and the seat is moved along the peripheral gliding tracks 60 and the central gliding track 50 onto the base 11. After that, the connecting plate 31 is folded. Thus the patient conveniently and with little effort is placed on the wheelchair 10.

When, on the other hand, the patient is to be transferred from the wheelchair 10 into the bed 70, the connecting plate

31 is laid on the edge of the bed as a bridge, the patient is positioned above the bed 70 by pushing the seat 20, and the patient is moved from the seat 20 into the bed 70.

When moving the patient, due to transferring the patient from the bed 70 to the wheelchair 10 by pushing the seat 20, a nurse only needs to move the patient from the bed into the seat 20 or from the seat 20 into the bed 70. Therefore, the nurse does not need to embrace the patient with a lot of effort to shift the patient. Physical efforts by the nurse are greatly reduced, and nursing work is facilitated.

Furthermore, when the patient is shifted, since the connecting plate 31 connects the wheelchair and the bed 70, the patient is never hanging freely, and there is no risk of the patient falling down.

While the invention has been described with reference to a preferred embodiment thereof, it is to be understood that modifications or variations may be easily made without departing from the spirit of this invention which is defined by the appended claims.

What is claimed is:

1. A wheelchair shifting aid, mounted on a base of a wheelchair, comprising:

a seat, mounted on an upper side of said base;

a central gliding track, located between said base and said seat, guiding said seat towards a front side of said wheelchair, then towards left and right sides of said wheelchair;

two connecting plates, hingedly connected with said base on two sides thereof, being able to be placed in horizontal positions, forming a single plane with said base; and several lateral guiding tracks on said two connecting plates for guiding said seat to glide on said connecting plates;

wherein said seat, guided by said connecting plates and said central guiding track, is moved to a lateral side of said wheelchair to aid a patient to shift from said lateral side of said wheelchair onto said wheelchair.

2. A wheelchair shifting aid according to claim 1, wherein said central gliding track further comprises:

several cylindrical rolls, guiding said seat to move towards said front side of said wheelchair; and several ball rollers, placed in front of said several cylindrical rolls, guiding said seat to move towards said front side and, after said seat has separated from said several cylindrical rolls, guiding said seat to move towards two sides of said wheelchair.

3. A wheelchair shifting aid according to claim 2, wherein each of said ball rollers further comprises a ball and a positioning rim, positioning said ball and allowing said ball to rotate freely at a fixed position on said base.

* * * * *